US008841852B2

(12) United States Patent
Naruo et al.

(10) Patent No.: US 8,841,852 B2
(45) Date of Patent: Sep. 23, 2014

(54) ILLUMINATION APPARATUS WITH SIGNAL FILTERS

(75) Inventors: Masahiro Naruo, Osaka (JP); Shigeru Ido, Osaka (JP); Sana Esaki, Osaka (JP); Akinori Hiramatu, Nara (JP)

(73) Assignee: Panasonic Corporation, Osaka (JP)

( * ) Notice: Subject to any disclaimer, the term of this patent is extended or adjusted under 35 U.S.C. 154(b) by 70 days.

(21) Appl. No.: 13/528,085

(22) Filed: Jun. 20, 2012

(65) Prior Publication Data

US 2012/0326617 A1 Dec. 27, 2012

(30) Foreign Application Priority Data

Jun. 22, 2011 (JP) ..... 2011-137995

(51) Int. Cl.
*H05B 37/02* (2006.01)
*H05B 33/08* (2006.01)

(52) U.S. Cl.
CPC ..... *H05B 33/0857* (2013.01)
USPC ..... 315/210; 343/151; 343/152; 343/158

(58) Field of Classification Search
USPC ..... 343/210, 151, 152, 158
See application file for complete search history.

(56) References Cited

U.S. PATENT DOCUMENTS 5,350,977 A 9/1994 Hamamoto et al.
2008/0048582 A1 2/2008 Robinson
2008/0272702 A1 11/2008 Van Erp et al.
2010/0194293 A1 8/2010 Deurenberg et al.
2011/0309754 A1 * 12/2011 Ashdown et al. ..... 315/151

FOREIGN PATENT DOCUMENTS

| | | | |
|---|---|---|---|
| CN | 1083572 | 3/1994 | |
| CN | 101512901 | 8/2007 | |
| CN | 101755483 | 6/2010 | |
| JP | 2009-518799 | 5/2009 | |
| WO | WO 2009019655 A2 * | 2/2009 | ..... H05B 33/08 |

OTHER PUBLICATIONS

Chinese Office Action dated Mar. 27,2014 for corresponding Chinese Application No. 201210212314.9, Search Report, and the English translations thereof.

* cited by examiner

*Primary Examiner* — Douglas W Owens
*Assistant Examiner* — Jae Kim
(74) *Attorney, Agent, or Firm* — Renner, Otto, Boisselle & Sklar, LLP

(57) ABSTRACT

An illumination apparatus is provided for outputting a light of mixed colors in a desired color temperature by controlling light outputs from light sources. The illumination apparatus includes a light output setting unit for outputting a set signal presenting a set value for adjusting an output of the light of mixed colors, and a first filter for smoothing the set signal from the light output setting unit. The illumination apparatus further includes a light output adjustment unit for adjusting the light outputs from the respective light sources based on the set signal smoothed by the first filter, and a plurality of second filters smoothing signals outputted from the light output adjustment unit to the light sources, respectively. Each of time constants of the second filters is lower than that of the first filter.

4 Claims, 4 Drawing Sheets

ILLUMINATION APPARATUS WITH SIGNAL FILTERS

FIELD OF THE INVENTION

The present invention relates to an illumination apparatus.

BACKGROUND OF THE INVENTION

Conventionally, there is provided a lighting system which irradiates a light in a desired color temperature by mixing different kinds of lights having different wavelengths (see, e.g., Japanese Patent Application Publication No. 2009-518799 (JP2009-518799A), paragraphs [0021] to [0023] and FIG. 1). The lighting system includes an illumination unit having a plurality of LEDs which emit lights of different wavelengths and an adjustment unit which adjusts the color temperature of a light emitted from the illumination unit. In the lighting system, when a color adjusting operation is conducted by a user, the adjustment unit adjusts a light output of each LED so that the light emitted from the illumination unit has a color temperature corresponding to the color adjusting operation.

As in the lighting system described in JP2009-518799A, when the output of LED of each color is adjusted based on a single-level signal according to the color mixing operation, the LEDs of the respective colors may not produce lights corresponding to a set output ratio in an excessive change in the output. The cause of this is explained as follows.

For example, in order to continually change a current flowing through the LEDs of respective colors and the color temperature of the light emitted from the illumination unit according to the output controlled by a microcomputer, a PWM (Pulse Width Modulation) timer circuit is preferably used to suppress an increase in cost. In this case, an output of the PWM timer circuit provided for the LED of each color is smoothed by a low pass filter to be used as an instruction value of the current flowing through the LED of each color. Further, the frequency of the PWM timer circuit is set to a value ranging from several hundred Hz to several kHz, and a time constant of the low pass filter is set to sufficiently smooth the frequency of the PWM timer circuit. For example, when the frequency of the PWM timer circuit is 1 kHz, the low pass filter may have a time constant of 0.16, which is sufficient to smooth the frequency of the PWM timer circuit.

Here, in a stable operation, the ratio between currents flowing through the LEDs of respective colors is determined based on a value stored in a memory of a microcomputer. In an excessive change of the output, however, the ratio may deviate from a set value due to the delay of the low pass filter smoothing the output of the PWM timer circuit. In detail, the currents flowing through the LEDs of respective colors continuously change from current values before a change of setting to current values after the change of setting based on a property of the low pass filter during the response time of the low pass filter and the currents flowing through the LEDs of the respective colors are set regardless of previously determined values. Thus, a light of an unexpected color is momentarily emitted. Such a problem is overcome by reducing the delay of the low pass filter smoothing the output of the PWM timer circuit. However, decreasing the delay of the low pass filter changes the currents flowing through the LEDs of respective colors in a period of the PWM timer circuit, thus causing flicker.

In order to prevent the flicker, the frequency of the PWM timer circuit may be increased. However, it is impossible to considerably increase the frequency of the PWM timer circuit due to a limit to a resolution of a current set value. For example, in a timer clock of 20 MHz, a 16-bit timer has a resolution of 50 ns. When an output of the PWM timer circuit is continuously changed with the resolution of the 16 bit-timer, one period is 65536 counts, and the frequency becomes about 300 Hz. Further, in a case of the resolution of a 14 bit-timer, the frequency is about 1.2 kHz. In order to further increase the frequency, the resolution is reduced, i.e., the timer clock is increased. However, it is impossible to reduce the resolution due to continuous dimming characteristics. Also, it is not preferable to increase the timer clock in consideration of power consumption or heat generation.

SUMMARY OF THE INVENTION

In view of the above, the present invention provides an illumination apparatus capable of producing a light by making an output ratio of light sources to be stable even in an excessive change of a light output.

In accordance with an aspect of the present invention, there is provided an illumination apparatus for outputting a light of mixed colors in a desired color temperature by controlling light outputs from a plurality of light sources which emit lights of different wavelengths, respectively.

The illumination apparatus includes: a light output setting unit for outputting a set signal presenting a set value for adjusting an output of the light of mixed colors; a first filter for smoothing the set signal from the light output setting unit; a light output adjustment unit for adjusting the light outputs from the respective light sources based on the set signal smoothed by the first filter; and a plurality of second filters smoothing signals outputted from the light output adjustment unit to the light sources, respectively.

Each of time constants of the second filters is lower than that of the first filter.

The light output adjustment unit may adjust ratios of the time constant of the first filter to those of the second filters to be great as a variation in the set value by the light output setting unit is greater.

The light output adjustment unit may periodically repeat an on-time in which the light sources are turned on and an off-time in which the light sources are turned off or repeats the on-time and a low-output on-time in which the light sources are turned on with a light output lower than that for the on-time, and changes a time ratio of the on-time according to the set signal from the light output setting unit.

The illumination apparatus in accordance with the present invention is capable of producing a light by making an output ratio of light sources to be stable even in an excessive change in the light output.

BRIEF DESCRIPTION OF THE DRAWINGS

The objects and features of the present invention will become apparent from the following description of preferred embodiments given in conjunction with the accompanying drawings, in which.

DETAILED DESCRIPTION OF THE EMBODIMENTS

Hereinafter, embodiments of the present invention will be described with reference to the accompanying drawings which form a part hereof.

Illumination apparatuses in accordance with an embodiment of the present invention will be described with reference to FIGS. 1 to 4. The illumination apparatuses of the present embodiment outputs a light of mixed colors having a desired color temperature by controlling light outputs from LEDs 7A to 7C of a plurality of kinds (three kinds in the embodiment) which emits the lights of different wavelengths, respectively.

Figure 1:
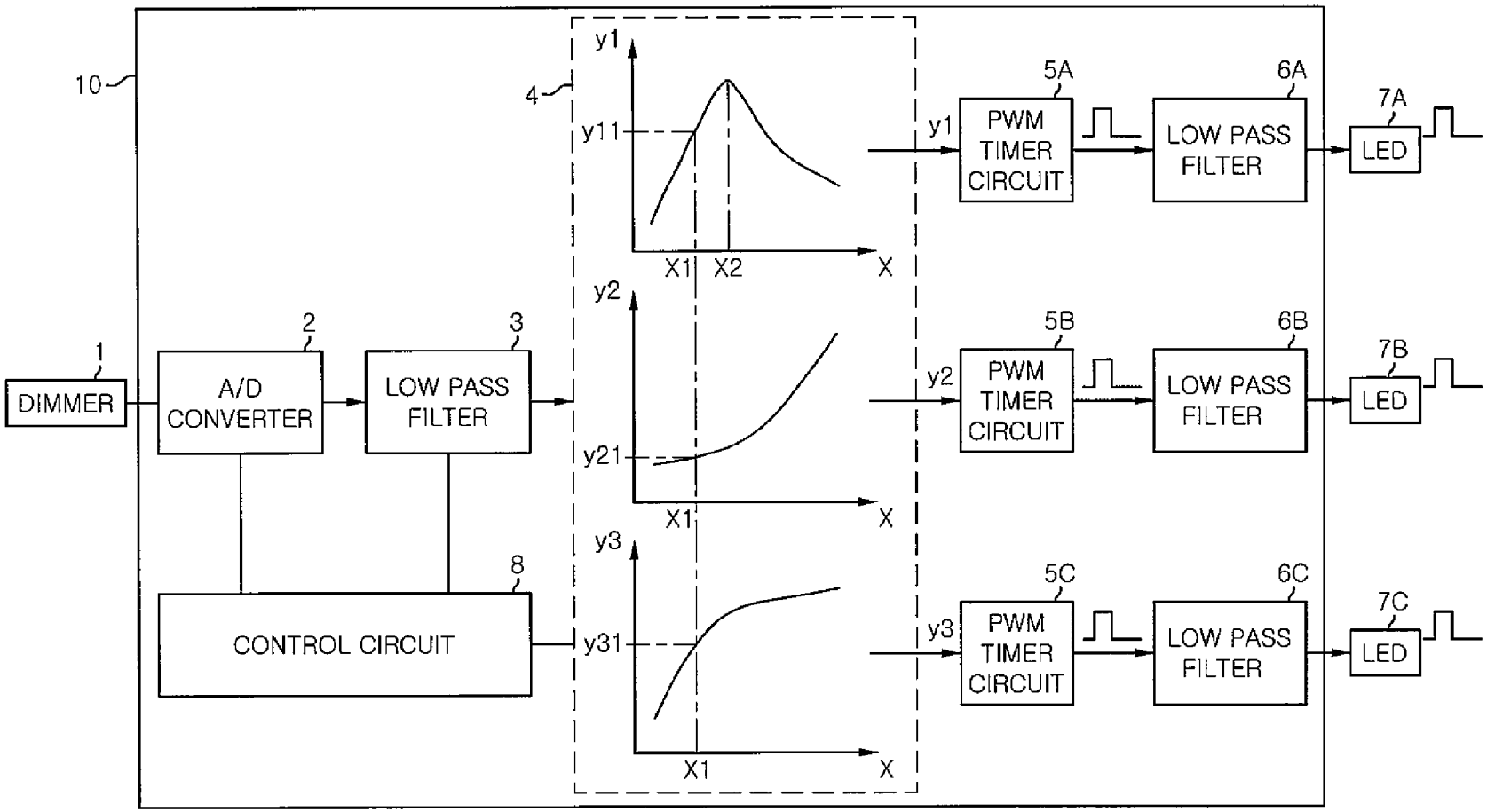
FIG. 1 is a schematic block diagram of an illumination apparatus in accordance with an embodiment of the present invention.

FIG. 1 is a schematic block diagram of the illumination apparatus in accordance with the present embodiment. The illumination apparatus includes a dimmer (light output setting unit) 1, a microcontroller (MCU) 10, and a plurality (three in FIG. 1) of LEDs (light sources) 7A to 7C. The microcontroller 10 includes an A/D converter 2, a first filter 3, a memory 4, a plurality (three in FIG. 1) of PWM timer circuits 5A to 5C, a plurality (three in FIG. 1) of second filters 6A to 6C, and a control circuit 8 performing overall control.

The LEDs 7A to 7C emit lights of different wavelengths, respectively. In the present embodiment, the LED 7A emits a red light, the LED 7B emits a green light, and the LED 7C emits a blue light, thereby generating a mixed light, i.e., a white light.

The dimmer 1 generates a set signal (dimming signal) presenting a set value for adjusting the output of the light of mixed colors and outputs the set signal to the A/D converter 2. In the present embodiment, the dimmer 1 outputs analog voltage, e.g., ranging from 0 V to 5 V as the set signal.

The A/D converter 2 periodically receives the set signal outputted from the dimmer 1 and converts the signal into a digital signal Dx to output the digital signal Dx to the first filter 3. The sampling frequency of the A/D converter 2 is set to a value ranging from several hundred Hz to several kHz, which is sufficient to respond to a dimming operation by a user. For example, when the A/D converter 2 is 10-bit, the digital signal Dx has a value ranging from 0 to 1023, corresponding to the voltage level of the set signal (e.g., 0 V to 5 V).

The first filter 3 is a low pass filter which attenuates a frequency band higher than a specific frequency (the cutoff frequency) and controls flicker by smoothing a change in the digital signal Dx outputted from the A/D converter 2. The first filter 3 smoothes the digital signal Dx outputted from the A/D converter 2 to output a signal value X and preferably attenuates frequency components of 10 Hz or higher.

Here, in the present invention, an analog voltage (set signal) outputted from the dimmer 1 is converted into a digital signal Dx. However, the analog voltage outputted from the dimmer 1 may be used as it is. In this case, the analog voltage may be discrete voltage. Thus, low-frequency components of 10 Hz may occur in the analog voltage depending on the operation speed of the dimmer 1. However, when the first filter 3 is provided as a first-order filter and has a time constant of 0.16, the cutoff frequency is 1 Hz, and thus a change of 10 Hz may be about 1/10 thereof. Thus, in this case, frequency components included in the analog voltage which cause disturbing flicker may be reduced. The first filter 3 will be described later.

The memory 4 stores in advance a data table showing relationships between a signal value X and output values y1 to y3 of the respective LEDs 7A to 7C, which are represented in the graphs in FIG. 1. When the signal value X is X1, the output value y1 of the LED 7A is y11, the output value y2 of the LED 7B is y21, and the output value y3 of the LED 7C is y31. Further, the output values y1 to y3 are stored in the memory 4 as 16-bit data, and a data occupying capacity of each of the output values y1 to y3 is 2 kilobytes. Further, in the graph of FIG. 1 showing the relationship between the signal value X and the output value y1, a range of X≤X2 is a first range in which the output value y1 is in proportion to a set signal from the dimmer 1, and a range of X>X2 is a second range in which the output value y1 is in reverse proportion to the set signal.

The output values y1 to y3 read by the memory 4 are inputted to the PWM timer circuits 5A to 5C, respectively, and the PWM timer circuits 5A to 5C determine an on-duty ratio of the LEDs 7A to 7C based on the output values y1 to y3. For example, when each of the PWM timer circuits is 16-bit and has a timer clock of 20 MHz, a resolution thereof is 50 ns and the on-duty ratio of PWM signal is set to 65536 stages. In the present embodiment, an on-time for which the LEDs 7A to 7C are turned on and an off-time for which the LEDs 7A to 7C are turned off are periodically repeated according to the PWM signals outputted from the PWM timer circuits 5A to 5C, which is so-called burst dimming. In the present embodiment, a time ratio of on-time changes based on the set signal from the dimmer 1.

Like the first filter 3, the second filters 6A to 6C are provided as a low pass filter which attenuates a frequency band higher than a specific frequency (the cutoff frequency) and smoothes the PWM signals outputted from the respective PWM timer circuits 5A to 5C. Here, in the present embodiment, the memory 4, the PWM timer circuits 5A to 5C, and the control circuit 8 form a light output adjustment unit, and the first filter 3 and the second filters 6A to 6C are provided as a digital filter.

Figure 2:
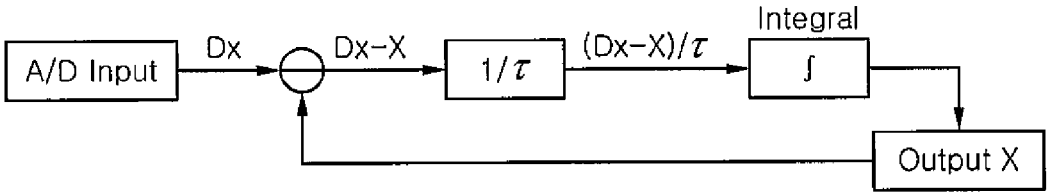
FIG. 2 illustrates the operations of a first filter in the illumination apparatus.

Next, an example of the operation of the first filter 3 will be described with reference to FIG. 2. The following description is made on the first filter 3 as a first-order filter, but the first filter 3 may be provided as a second-order filter.

The first filter 3 calculates a difference Dx-X between the digital signal Dx outputted from the A/D converter 2 and the signal value (output value) X, divides the difference Dx-X by a coefficient $\tau$, and finally integrates the division result $(Dx-X)/\tau$, thereby obtaining a signal value X. Here, defining an operation cycle as $\tau$ and a time constant as A, e.g., if T=1 ms and T=160, $A=T\times\tau=0.001\times160=0.16$.

However, comparing the time constant of the first filter 3 which smoothes the set signal from the dimmer 1 with the time constants of the second filters 6A to 6C which smooth the PWM signals from the PWM timer circuits 5A to 5C, when the time constants of the second filters 6A to 6C are same as the time constant of the first filter 3 or higher, an output according to the set signal from the dimmer 1 may be inputted to the LEDs 7A to 7C while the LEDs 7A to 7C are in dimming status. Then, a next dimming operation may be performed during a dimming operation of the LEDs 7A to 7C, and accordingly, a light of unexpected color is emitted momentarily. Accordingly, in the present embodiment, the time constants of the first filter 3 and the second filters 6A to 6C are set such that the time constants of the second filters 6A to 6C are smaller than the time constant of the first filter 3. Then, the output according to the next dimming signal is not inputted to the LEDs 7A to 7C until the LEDs 7A to 7C complete the dimming operation, and thus the LEDs 7A to 7C produce a light of colors in a stable ratio even when the light output excessively changes. In the present embodiment, since the first filter 3 and the second filters 6A to 6C are provided as a digital filter, the time constants of the first filter 3 and the second filters 6A to 6C may be arbitrarily set. In the present embodiment, as a variation in the set value outputted from the dimmer 1 is greater, the time constant of the first filter 3 is adjusted to be great and the ratios of the time constant of the first filter 3 to those of the second filters 6A to 6C are also set to be great. As a result, the LEDs 7A to 7C produce a light of colors in a stable ratio even when the light output excessively change.

Next, the operations of the illumination apparatus will be described with reference to FIGS. 3A and 3B. The following description will be made based on the operation of the LED 7A. Since the LEDs 7B and 7C operate in the same manner as the LED 7A, the descriptions thereof are omitted herein.

Figure 3A:
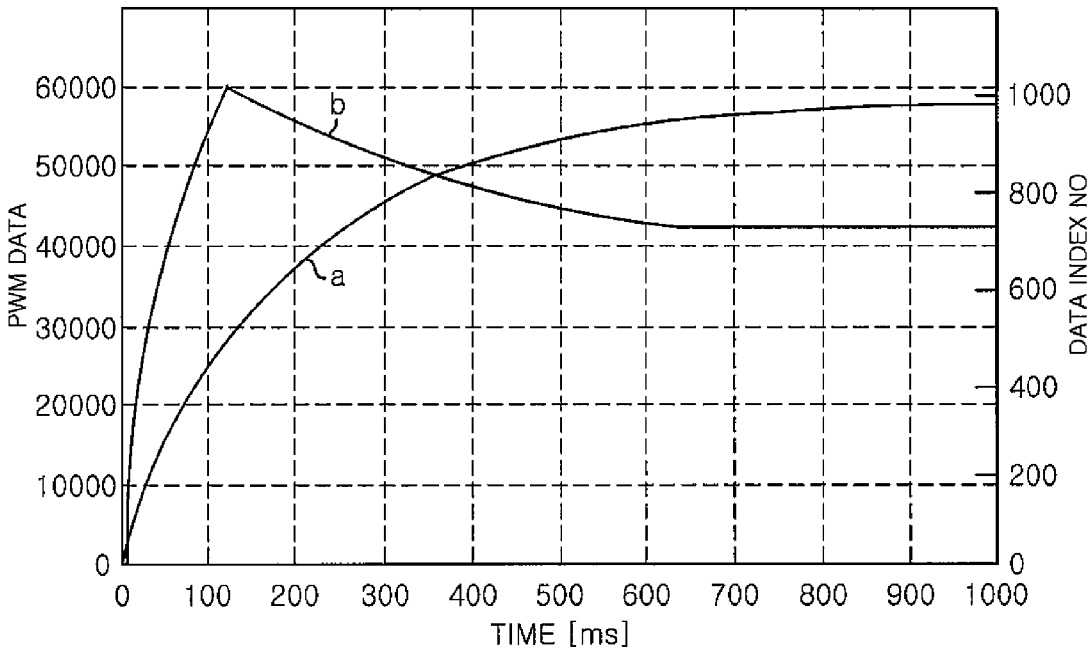
FIGS. 3A and 3B are graphs illustrating the operations of the illumination apparatus.
Figure 3B:
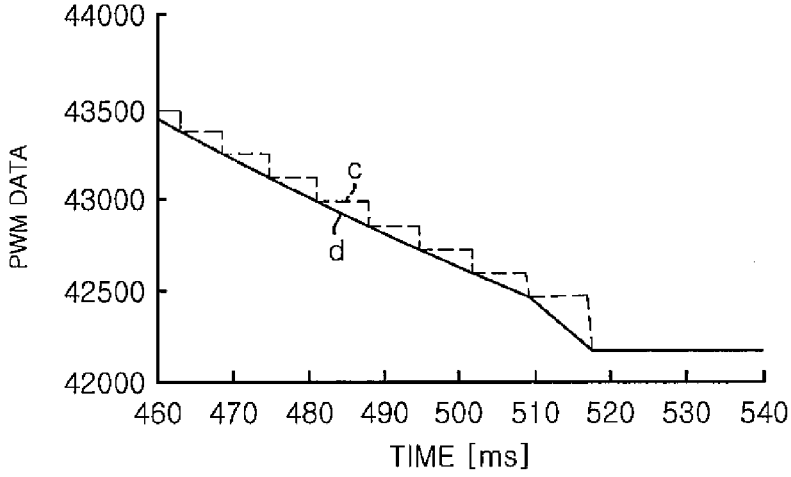

FIG. 3A is a graph showing variations in the signal value X (data index No.) and the output value y1 (PWM data) as time lapses, wherein the solid line a shows a variation in the signal value X and the solid line b shows a variation in the output value y1. According to the graph, e.g., when a dimming level (digital signal Dx) changes from 20 to 1000 by the dimmer 1 at vicinity of t=0, the signal value X from the first filter 3 makes a response with a first-order delay. Since the output value y1 is determined on the signal value X from the first filter 3, it reaches the peak at t=120 ms and gradually decreases after that as shown in the solid line b.

Here, there are 1024 sets of data to represent the relationship between the signal value X and the output value y1. However, there is a case where the signal value X does not change despite a change in the output value y1, because the output value y1 is 16-bit while the signal value X is 10-bit and has an insufficient resolution. In this case, the signal value X is expanded to 27-bit (the resolution of the output value y1+the resolution of the digital signal Dx+sign bit), so that the signal value X can have a sufficient resolution for the resolution of the output value y1 in a data table having any characteristic, which will be described as an example below.

When conducting an operation, the first filter 3 expands, e.g., a resolution of 10 bits to 32 bits through a division operation and determines a data table by using upper 10 bits except for a sign bit. Also, the first filter 3 performs interpolation using the remaining lower bits thereby correcting the output value y1 to change continuously (see FIG. 3B). That is, the first filter 3 conducts the interpolation of the output value y1 by using the remaining lower bits, in which the insufficient resolution of the signal value X for the resolution of the output value y1 is supplemented. In FIG. 3B, the broken line c denotes an output value y1 before interpolation, and the solid line d denotes an output value y1 after the interpolation.

Figure 4:
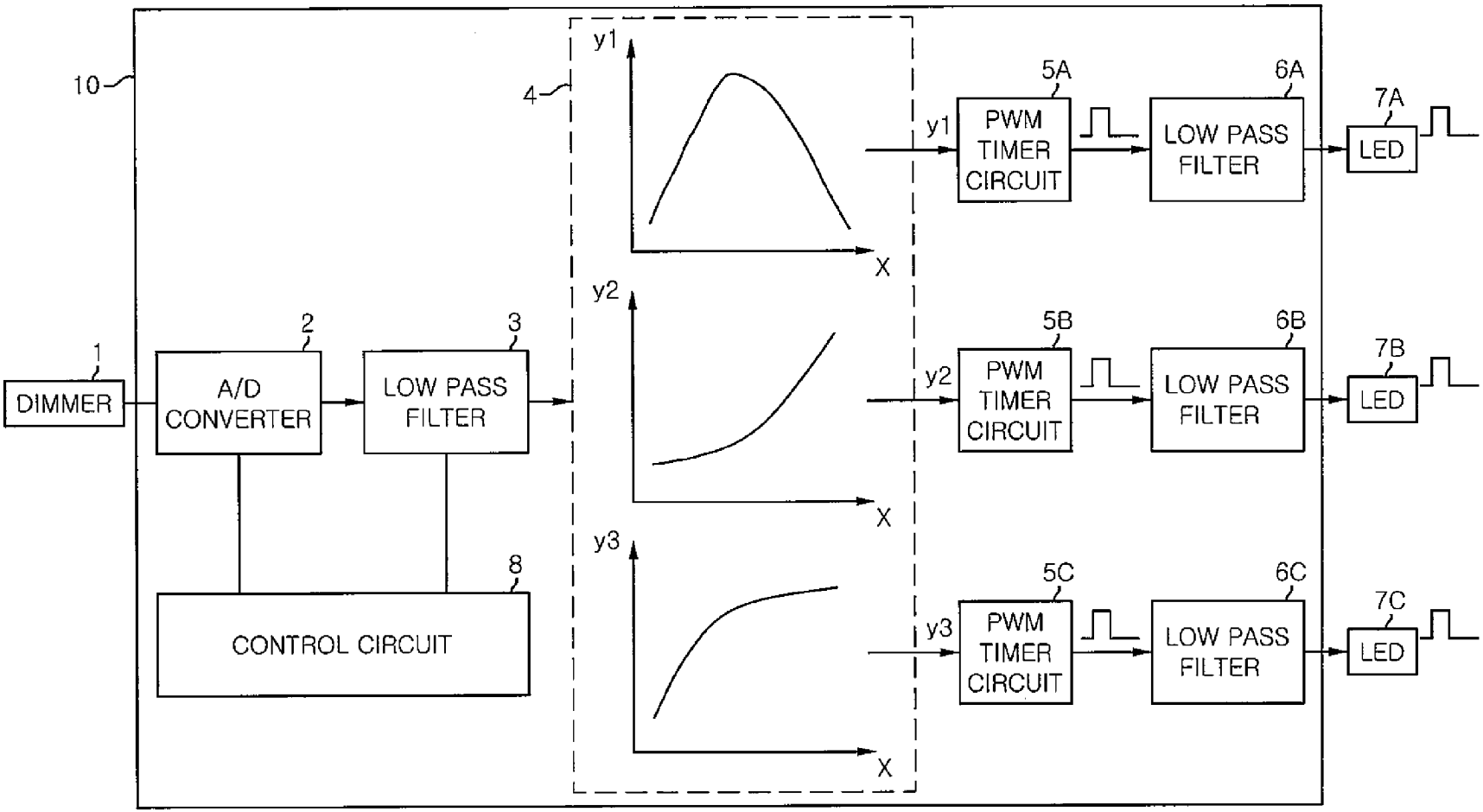
FIG. 4 is a schematic block diagram of another example of an illumination apparatus in accordance with the embodiment of the present invention.

FIG. 4 is a schematic block diagram of another example of the illumination apparatus. FIG. 1 illustrates the second filters 6A to 6C as a digital filter, while FIG. 4 illustrates second filters 6A to 6C as an analog filter. The other components are the same as those illustrated in FIG. 1, like reference numerals will be given to like parts, and redundant description thereof will be omitted.

The illumination apparatus includes a dimmer 1, a microcontroller 10, and a plurality (three in FIG. 4) of LEDs 7A to 7C. The microcontroller 10 includes an A/D converter 2, a first filter 3, a memory 4, a plurality (three in FIG. 4) of PWM timer circuits 5A to 5C, a plurality (three in FIG. 1) of second filters 6A to 6C, and a control circuit 8 performing overall control.

Here, since the second filters 6A to 6C are an analog filter, the time constants of the filters have predetermined values. Further, since the first filter 3 is a digital filter, the time constant of the filter may be arbitrarily set. In the present embodiment, the time constants of the second filters 6A to 6C is set to be less than the time constant of the first filter 3. Further, when a variation in the set value from the dimmer 1 is greater, the ratios of the time constant of the first filter 3 to those of the second filters 6A to 6C are adjusted to be great. As a result, like the illumination apparatus in FIG. 1, the LEDs 7A to 7C can produce a light at a stable ratio of colors even when the light output excessively change.

In accordance with the present embodiment, the delay time of an output signal (PWM signal) from the light output adjustment unit is adjusted to be short with respect to the delay time of the set signal (dimming signal) from the dimmer 1, and thus the LEDs 7A to 7C produce a light at a stable ratio of colors even in an excessive change in the light output. Further, when a variation in a set value from the dimmer 1 is great, the ratios of the time constant of the first filter 3 to those of the second filters 6A to 6C are adjusted to be great, and accordingly, the LEDs 7A to 7C can produce a light at a stable ratio of colors even when the light output excessively changes.

Moreover, if the first filter 3 is provided as a digital filter as in the present embodiment, the time constant of the first filter 3 is processed within the microcontroller 10, thus preventing occurrence of flicker by noise. Also, the illumination apparatus in accordance with the present embodiment enables the respective LEDs 7A to 7C to perform burst dimming.

Although the present embodiment illustrates the LEDs 7A to 7C as an example of a light source, the light source is not limited thereto. Any light source may be employed as long as it has a configuration in which different colors of light emitted from respective light sources can be mixed. Further, the number of light sources is not limited to the examples of the embodiment and may be two, four or more. In the present embodiment, burst dimming is carried out by repeating the on-time and the off-time. Alternatively, a low-output on-time may be adopted instead of the off-time in which the LEDs 7A to 7C are lit with a light output lower than that for the on-time. Also, the on-time and the low-output on-time may be repeated, thereby performing the burst dimming.

While the invention has been shown and described with respect to the embodiments, it will be understood by those skilled in the art that various changes and modification may be made without departing from the scope of the invention as defined in the following claims.

What is claimed is:

1. An illumination apparatus for outputting a light of mixed colors in a desired color temperature by controlling light outputs from a plurality of light sources which emit lights of different wavelengths, respectively, the illumination apparatus comprising:

a light output setting unit for outputting a set signal presenting a set value for adjusting an output of the light of mixed colors;

a first filter for smoothing the set signal from the light output setting unit;

a light output adjustment unit for adjusting the light outputs from the respective light sources based on the set signal smoothed by the first filter; and a plurality of second filters smoothing signals outputted from the light output adjustment unit to the light sources, respectively, wherein each of time constants of the second filters is lower than that of the first filter.

2. The illumination apparatus of claim 1, wherein when a variation of the set value by the light output setting unit increases, the light output adjustment unit increases respective ratios of the time constant of the first filter to the time constants of the second filters.

3. The illumination apparatus of claim 1, wherein the light output adjustment unit periodically repeats an on-time in which the light sources are turned on and an off-time in which the light sources are turned off or repeats the on-time and a low-output on-time in which the light sources are turned on with a light output lower than that for the on-time and changes a time ratio of the on-time according to the set signal from the light output setting unit.

4. The illumination apparatus of claim 2, wherein the light output adjustment unit periodically repeats an on-time in which the light sources are turned on and an off-time in which the light sources are turned off or repeats the on-time and a low-output on-time in which the light sources are turned on with a light output lower than that for the on-time and changes a time ratio of the on-time according to the set signal from the light output setting unit.

* * * * *